US011927361B2

(12) United States Patent
Nakashima et al.

(10) Patent No.: US 11,927,361 B2
(45) Date of Patent: Mar. 12, 2024

(54) INDOOR UNIT AND AIR-CONDITIONING APPARATUS

(71) Applicant: Mitsubishi Electric Corporation, Tokyo (JP)

(72) Inventors: Hiroki Nakashima, Tokyo (JP); Keisuke Tomomura, Tokyo (JP); Tatsuo Furuta, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 420 days.

(21) Appl. No.: 17/299,335

(22) PCT Filed: Feb. 22, 2019

(86) PCT No.: PCT/JP2019/006784

§ 371 (c)(1),
(2) Date: Jun. 3, 2021

(87) PCT Pub. No.: WO2020/170423

PCT Pub. Date: Aug. 27, 2020

(65) Prior Publication Data

US 2022/0057107 A1 Feb. 24, 2022

(51) Int. Cl.
*F24F 13/20* (2006.01)
*F24F 1/0047* (2019.01)

(52) U.S. Cl.
CPC ..... *F24F 13/20* (2013.01); *F24F 1/0047* (2019.02)

(58) Field of Classification Search
CPC ..... F24F 13/20; F24F 1/0047; F24F 2221/32
USPC ..... 62/259.1
See application file for complete search history.

(56) References Cited

U.S. PATENT DOCUMENTS 1,937,288 A * 11/1933 McGraw ..... F25B 29/003 62/331
4,458,502 A * 7/1984 Adachi ..... F24F 1/0057 62/263
2009/0019872 A1* 1/2009 Kotani ..... F25B 41/34 62/515

(Continued)

FOREIGN PATENT DOCUMENTS

EP 2080958 A2 * 7/2009 ..... B66D 1/40
JP H11-094294 A 4/1999

(Continued)

OTHER PUBLICATIONS

WO-2013129527-A1, machine translation (Year: 2023).*

(Continued)

*Primary Examiner* — Eric S Ruppert
*Assistant Examiner* — Kirstin U Oswald
(74) *Attorney, Agent, or Firm* — POSZ LAW GROUP, PLC

(57) ABSTRACT

An indoor unit includes a housing that houses an electrical-component storage box that includes a body portion, a lid portion, and an engagement mechanism portion that engages the body portion and the lid portion with each other in a detachable manner. The lid portion covers an open region on a side of the body portion. The engagement mechanism portion includes an engagement claw portion provided at one of the body and lid portions and an engagement hole portion into which the claw portion is inserted, and which is formed at the other of the body and lid portions.

6 Claims, 7 Drawing Sheets

(56) References Cited

U.S. PATENT DOCUMENTS

| | | | | |
|---|---|---|---|---|
| 2009/0056358 | A1* | 3/2009 | Kotani | F24F 5/0017 62/259.1 |
| 2009/0139252 | A1* | 6/2009 | Yamashita | F24F 1/0063 62/259.1 |
| 2017/0045259 | A1* | 2/2017 | Choi | F24F 13/1426 |
| 2018/0328620 | A1 | 11/2018 | Iwatsuki et al. | |
| 2020/0072489 | A1 | 3/2020 | Nakamura et al. | |

FOREIGN PATENT DOCUMENTS

| | | | | |
|---|---|---|---|---|
| JP | 2006-132937 | A | 5/2006 | |
| WO | WO-2013129527 | A1 * | 9/2013 | F24F 1/0007 |
| WO | 2017/002237 | A1 | 1/2017 | |
| WO | 2017/122343 | A1 | 7/2017 | |
| WO | 2018/216085 | A1 | 11/2018 | |

OTHER PUBLICATIONS

Office Action dated Jul. 12, 2022 issued in corresponding JP Patent Application No. 2021-501255 (and English translation).
International Search Report of the International Searching Authority dated Apr. 23, 2019 for the corresponding International application No. PCT/JP2019/006784 (and English translation).
Office Action dated Apr. 25, 2022 issued in corresponding CN Patent Application No. 201980087216.7 (and English translation).
Office Action dated Oct. 12, 2022 issued in corresponding CN Patent Application No. 201980087216.7 (and English translation).
Office Action dated Feb. 8, 2022 issued in corresponding JP patent application No. 2021-501255 (and English translation).

* cited by examiner

INDOOR UNIT AND AIR-CONDITIONING APPARATUS

CROSS REFERENCE TO RELATED APPLICATION

This application is a U.S. national stage application of PCT/JP2019/006784 filed on Feb. 22, 2019, the contents of which are incorporated herein by reference.

TECHNICAL FIELD

The present disclosure relates to an indoor unit including an electrical-component storage box that stores electrical components, and also relates to an air-conditioning apparatus.

BACKGROUND ART

In existing air-conditioning apparatuses, for example, a four-way cassette indoor unit is configured such that the body of the indoor unit is suspended in a space above a ceiling of a room, and a decorative panel is attached to and covers a side of the body of the indoor unit that faces the interior of the room. This type of ceiling concealed indoor unit includes an electrical-component storage box that is provided in a housing to store electrical components to be provided in the indoor unit. This electrical-component storage box includes a body portion in which an open region is provided on one side of the body portion to allow electrical components to be stored in the body portion, a lid portion that covers the open region on the above one side of the body portion, and an engagement mechanism portion that engages the body portion and the lid portion with each other such that the lid portion is detachable from the body portion. In the electrical-component storage box, the lid portion is engaged with the body portion by the engagement mechanism portion such that the lid portion can be kept opened while being suspended from the body portion without being completely detached from the body portion (see, for example, Patent Literature 1). Therefore, at the time of doing on-site wiring work and maintenance work after installation of the indoor unit at the ceiling, the time and labor required to attach and detach the lid portion to and from the body portion are saved, and the operating efficiency of the work that is done especially at a high place or in a narrow work space is improved.

CITATION LIST

Patent Literature

Patent Literature 1: Japanese Unexamined Patent Application Publication No. 2006-132937

SUMMARY OF INVENTION

Technical Problem

However, in an electrical-component storage box in an existing indoor unit, attachment holes for screws are formed in a lid portion to fix a lid portion to a body portion. Each of the attachment holes has such a shape as to allow a screw to be inserted through the attachment hole. The screws need to be removed from the body portion each time the lid portion is opened/closed. Thus, at the time of doing on-site wiring work and maintenance work after installation of the indoor unit at a ceiling of a room, time and labor are required to remove the screws from the body portion to open/close the lid portion. Consequently, the above work is complicated, and the operating efficiency of the work that is done especially at a high place or in a narrow work space is lowered.

The present disclosure is applied to solve the above problem, and relates to an indoor unit and an air-conditioning apparatus that can simplify work that is done after installation of the indoor unit at a ceiling, and improve the operating efficiency.

Solution to Problem

An indoor unit according to an embodiment of the present disclosure includes: a housing; and an electrical-component storage box housed in the housing, and configured to store electrical components. The electrical-component storage box includes: a body portion formed such that an open region is provided on at least one side of the body portion, and configured to store the electrical components; a lid portion configured to cover the open region on the at least one side of the body portion; and an engagement mechanism portion configured to engage the body portion and the lid portion with each other such that the lid portion is detachable form the body portion. The engagement mechanism portion includes an engagement claw portion having a strip shape and provided at one of the body portion and the lid portion, and also includes an engagement hole portion into which the engagement claw portion is inserted, the engagement hole portion having a rectangular shape and being formed at the other of the body portion and the lid portion. The engagement claw portion includes protruding portions that are located opposite to each other on respective side portions of the engagement claw portion that are located on both sides of the engagement claw portion in a length direction thereof, the protruding portions protruding outward in the length direction. The engagement hole portion includes notch portions that are located opposite to each other at respective side portions of the engagement hole portion that are located on both sides of the engagement hole portion in a length direction thereof, the notch portions being formed in such a manner as to correspond in shape to the protruding portions of the engagement claw portion, the notch portions protruding outward in the length direction. The lid portion includes a keyhole for a screw to fix the lid portion to the body portion.

An air-conditioning apparatus according to another embodiment of the present disclosure includes the above indoor unit and an outdoor unit. The indoor unit includes an indoor heat exchanger. The outdoor unit includes an outdoor heat exchanger, a compressor, and an expansion device. The indoor heat exchanger and the outdoor heat exchanger are connected by pipes to form a refrigerant circuit.

Advantageous Effects of Invention

According to the embodiments of the present disclosure, the lid portion is detachably engaged with the body portion by the engagement mechanism portion, and the lid portion is fixed to the body portion by the screw. In this case, the keyhole for the screw is formed in the lid portion, and the screw is screwed to the body portion in a loosened state, that is, without being completely removed. In this state, the lid portion is slid such that the screw is relatively shifted along the keyhole, whereby the lid is openable and closable. It is therefore possible to save the time and labor that are required to insert and remove a fixing screw into and from the lid portion at the time of doing on-site wiring work and maintenance work after installation of the indoor unit at a ceiling, and simplify the work that is done especially at a high place or in a narrow work space after the installation of the indoor unit in a ceiling. Accordingly, the operating efficiency can be improved.

DESCRIPTION OF EMBODIMENTS

Embodiments of the present disclosure will be described with reference to the drawings. It should be noted that the configurations of the components described in the entire text of the specification are merely examples, and these descriptions are not limiting. That is, the embodiments can be modified as appropriate without departing from the subject matter or concept of the present disclosure that can be read from the claims and the entire specification. Indoor units and air-conditioning apparatuses according to such modifications of the embodiments are also covered by the technical concept of the present disclosure. Furthermore, in each of the above figures, components that are the same as those in a previous figure or figures are denoted by the same reference sign. The same is true of the entire text of the specification.

Embodiment 1

<Configuration of Indoor Unit 20>

Figure 1:
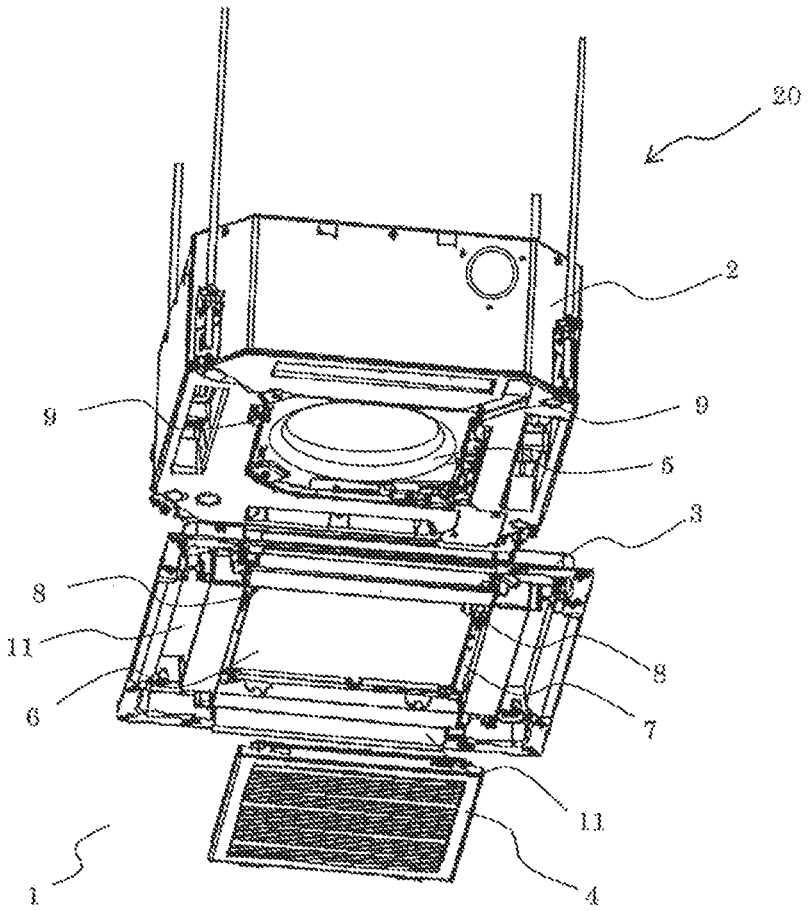
FIG. 1 is an exploded perspective view of an indoor unit according to Embodiment 1 of the present disclosure.
Figure 2:
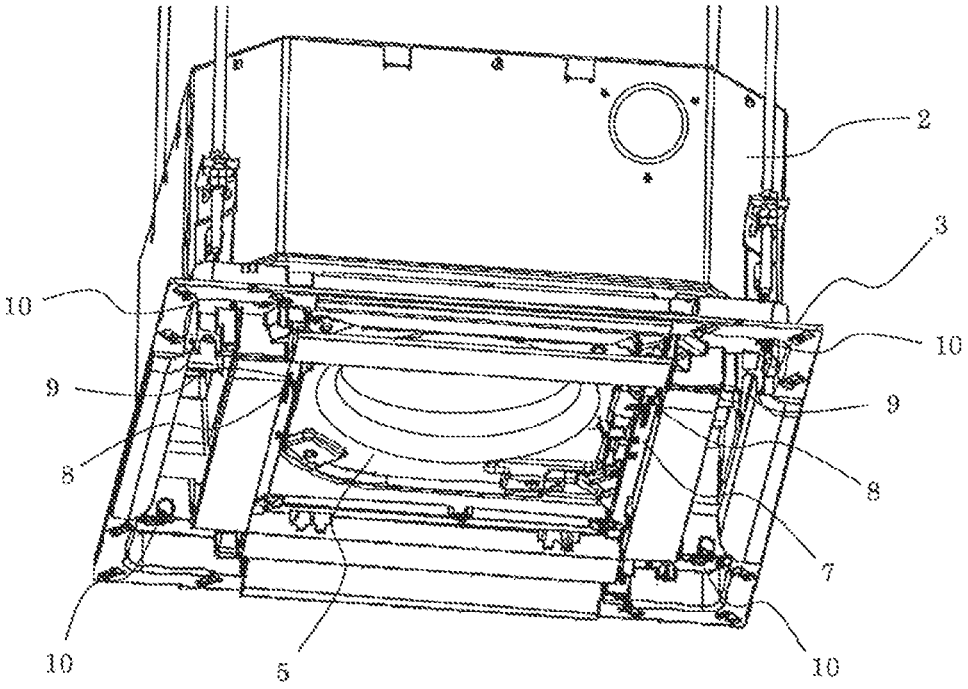
FIG. 2 is a perspective view of the indoor unit as illustrated in FIG. 1 which is provided, with a decorative panel attached to a housing of the indoor unit.
Figure 3:
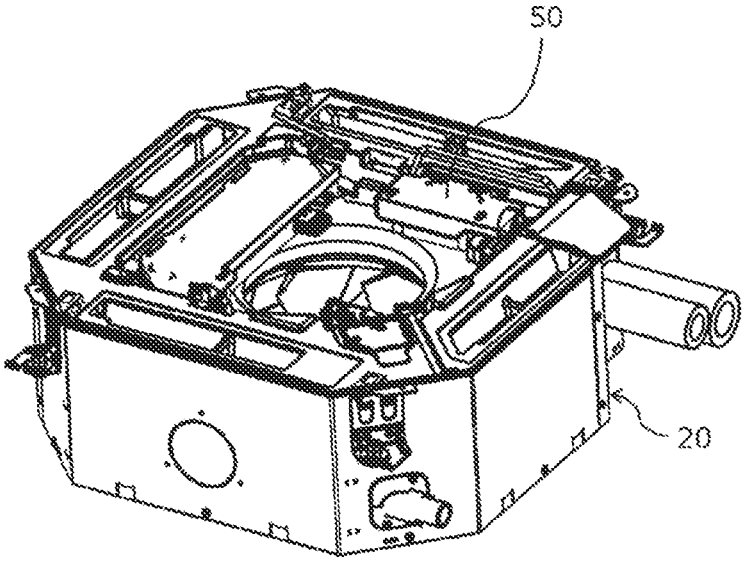
FIG. 3 is a perspective view illustrating the indoor unit as illustrated in FIG. 1.

FIG. 1 is an exploded perspective view of an indoor unit 20 according to Embodiment 1 of the present disclosure. FIG. 2 is a perspective view illustrating a housing 2 of the indoor unit 20 as illustrated in FIG. 1. FIG. 3 is a perspective view illustrating the indoor unit 20 as illustrated in FIG. 1. The indoor unit 20 according to Embodiment 1 is connected to an outdoor unit by a refrigerant pipe (not illustrated). The indoor unit 20 and the outdoor unit form an air-conditioning apparatus that circulates refrigerant in a refrigerant circuit to perform refrigeration, air conditioning, or other operations. It should be noted that the indoor unit 20 according to Embodiment 1 is a ceiling concealed indoor unit, and as an example of the ceiling concealed indoor unit, a four-way cassette indoor unit will be described.

As illustrated in FIGS. 1 to 3, the indoor unit 20 according to the present embodiment is installed such that the indoor unit 20 is embedded in a ceiling located above an indoor space 1. The following description is made on the assumption that a side in which the ceiling is located is an upper side, and a side where the indoor space 1 is located relative the ceiling is a lower side. The indoor unit 20 includes the housing 2 that houses an indoor fan, an indoor heat exchanger, and other devices (not illustrated), a decorative panel 3, and a suction grille 4. The housing 2 includes a bell mouth 5 configured to rectify air when the indoor fan is driven. The bell mouth 5 is located at an opening formed in the housing 2. At part of the housing 2 that is located outward of the bell mouth 5, a pair of temporary hooks 9 are provided to allow the decorative panel 3 to be temporarily hooked to the temporary hooks 9.

The decorative panel 3 is attached to a lower side of the housing 2 that is located on an indoor-space side, in such a manner as to cover the housing 2. At a central part of the decorative panel 3, a rectangular opening is provided at a position corresponding to the position of the opening of the housing 2 to provide an air inlet space 6 into which indoor air is sucked when the indoor fan is driven. The air inlet space 6 is covered with the suction grille 4. Edges of four sides of the decorative panel 3 that define the air inlet space 6 form air-inlet edge portions 7. Furthermore, air outlets 11 are provided outward of the air-inlet edge portions 7 to allow air that has passed through the indoor heat exchanger to be blown out to the indoor space.

To two of the four sides of the air-inlet edge portions 7 that are located opposite to each other, that is, to one of two pairs of opposite sides, temporary levers 8 are attached. The temporary levers 8 extend through the decorative panel 3 and protrude from an upper side of the decorative panel 3. The temporary levers 8 are located symmetrical with respect to a line that extends parallel to the above two opposite sides and passes through the center of the air inlet space 6. The temporary levers 8 are temporarily hooked to the temporary hooks 9 at the housing 2 which are located at positions where the temporary hooks 9 face the temporary levers 8.

At four corners of the decorative panel 3, setting screw portions 10 are provided to enable the decorative panel 3 to be fixed to the housing 2 by screws. At the time of fixing and setting the decorative panel 3 to the housing 2, first, the decorative panel 3 is located below the housing 2, and then moved upward and closer to the housing 2. The indoor unit 20 includes an electrical-component storage box 50 that is provided in the housing 2 and configured to store electrical components (not illustrated).

<Configuration of Electrical-Component Storage Box 50>

Figure 4:
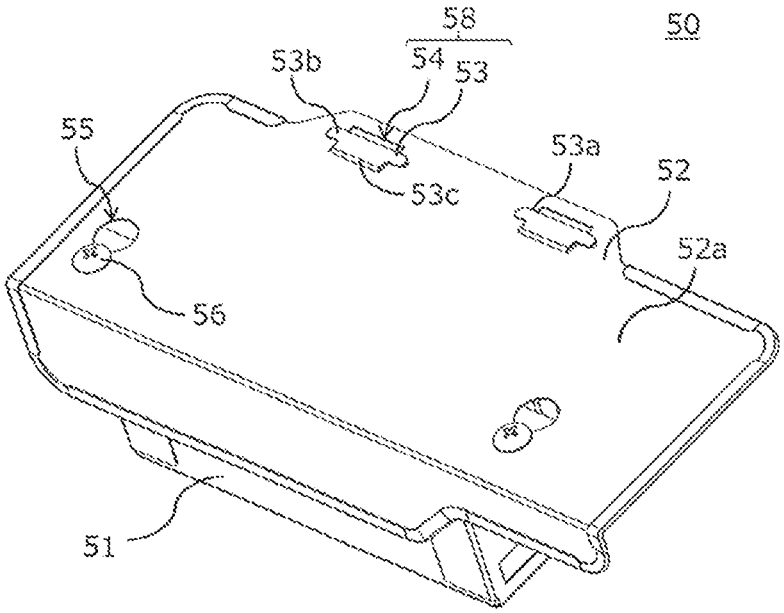
FIG. 4 is a perspective view illustrating an electrical-component storage box in the indoor unit as illustrated in FIG. 3.
Figure 5:
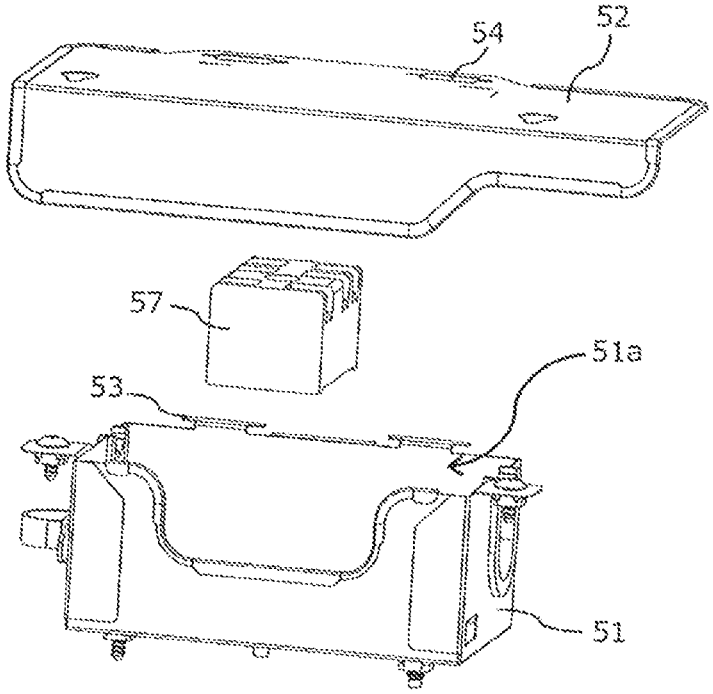
FIG. 5 is an exploded view illustrating the electrical-component storage box in the indoor unit as illustrated in FIG. 3.
Figure 6:
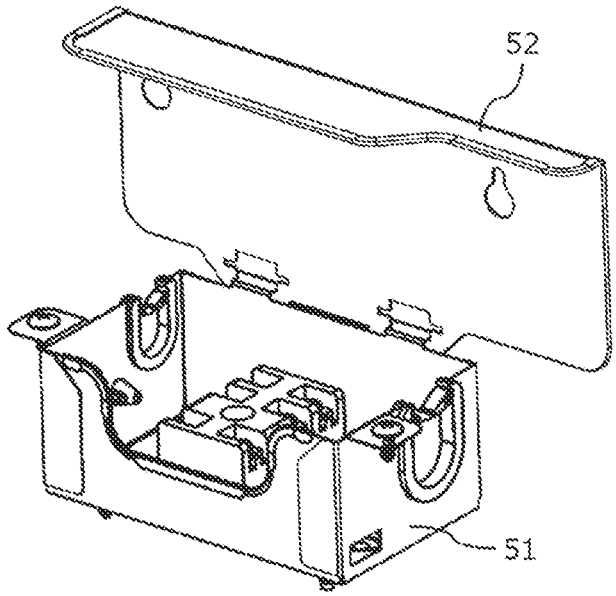
FIG. 6 is a perspective view illustrating an opened state of the electrical-component storage box in the indoor unit as illustrated in FIG. 3.
Figure 7:
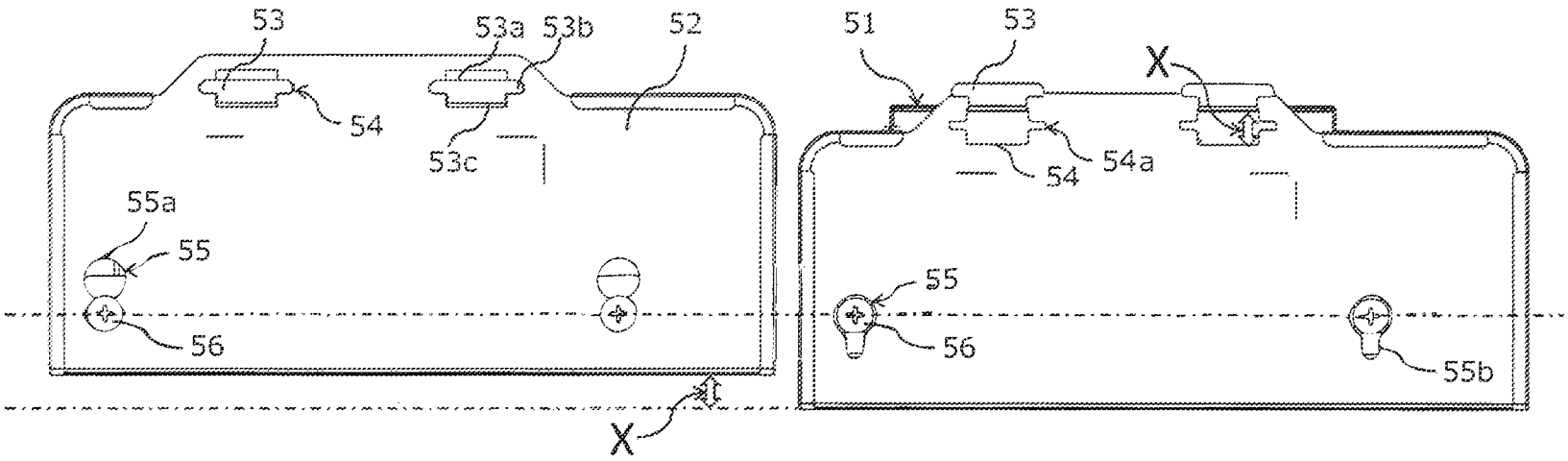
FIG. 7 is an explanatory plan view illustrating a lid portion of the electrical-component storage box in the indoor unit as illustrated in FIG. 3 in the case where the lid portion is slid.
Figure 8:
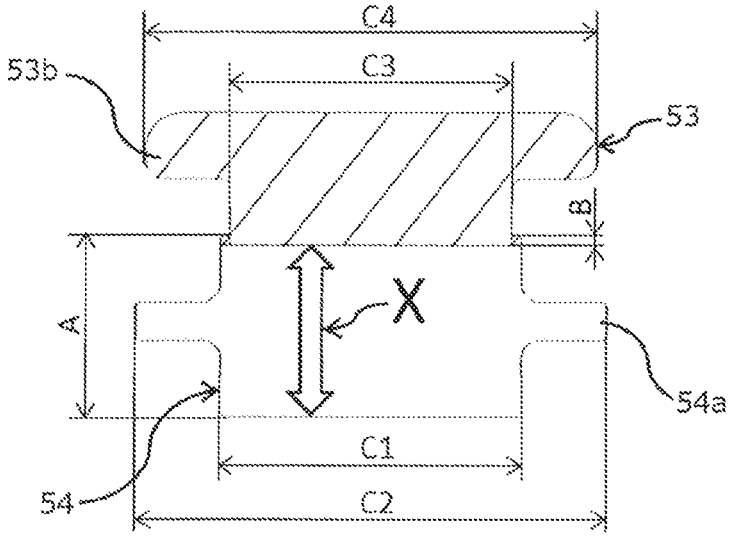
FIG. 8 is an explanatory partially-enlarged plan view illustrating the lid portion of the electrical-component storage box in the indoor unit as illustrated in FIG. 3 in the case where the lid portion is slid.
Figure 9:
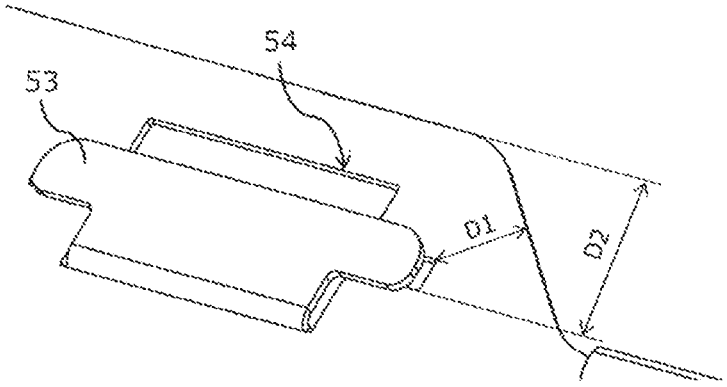
FIG. 9 is an enlarged perspective view illustrating related part of an engagement mechanism portion of the electrical-component storage box in the indoor unit as illustrated in FIG. 3.

Next, the electrical-component storage box 50 will be described. FIG. 4 is a perspective view illustrating the electrical-component storage box 50 in the indoor unit 20 as illustrated in FIG. 3. FIG. 5 is an exploded view illustrating the electrical-component storage box 50 in the indoor unit 20 as illustrated in FIG. 3. FIG. 6 is a perspective view illustrating an opened state of the electrical-component storage box 50 in the indoor unit 20 as illustrated in FIG. 3. FIG. 7 is an explanatory plan view illustrating the electrical-component storage box 50 in the indoor unit 20 as illustrated in FIG. 3 in the case where a lid portion 52 of the electrical-component storage box 50 is slid. FIG. 8 is an explanatory partially-enlarged plan view illustrating of the electrical-component storage box 50 in the indoor unit 20 as illustrated in FIG. 3 in the case where the lid portion 52 is slid. FIG. 9 is an enlarged perspective view illustrating related part of an engagement mechanism portion 58 of the electrical-component storage box 50 in the indoor unit 20 as illustrated in FIG. 3.

As illustrated in FIGS. 4 to 7, the electrical-component storage box 50 includes a body portion 51 in which an open region is provided on at least a side 51*a*, and which stores electrical components such as a terminal block 57, and the lid portion 52 that covers the open region provided on the side 51*a* of the body portion 51. The electrical-component storage box 50 includes engagement mechanism portions 58 configured to engage the body portion 51 and the lid portion 52 with each other such that the lid portion 52 can be detached from the body portion 51.

To be more specific, each of the engagement mechanism portions 58 includes: an engagement claw portion 53 that has a strip shape and is provided at one of the body portion 51 and the lid portion 52; and an engagement hole portion 54 that allows the engagement claw portion 53 to be inserted thereinto, and that has a rectangular shape and is provided at the other of the body portion 51 and the lid portion 52. It should be noted that Embodiment 1 will be descried referring to the case where the engagement claw portion 53 is provided at the body portion 51, and the engagement hole portion 54 is provided at the lid portion 52, however, it is not limiting.

The engagement claw portion 53 includes protruding portions 53*b* that are located opposite to each other at respective side portions of the engagement claw portion 53 that are located both sides of the engagement claw portion 53 in a length direction thereof, that is, at respective distal end portions 53*a*. The protruding portions 53*b* each protrude outwards in the length direction. The engagement claw portion 53 further includes a proximal end portion 53*c* at an upper end portion of a back side of the body portion 51. The engagement claw portion 53 is bent rearward from the proximal end portion 53*c* toward the distal end portion 53*a*. To be more specific, the engagement claw portion 53 is bent rearward from the proximal end portion 53*c* toward the distal end portion 53*a* and outward in a direction parallel to the open region on the side 51*a* of the body portion 51. It should be noted that in the case where the engagement claw portion 53 is provided at the lid portion 52, the engagement claw portion 53 is bent outward in a direction parallel to a lid surface 52*a* of the lid portion 52. The lid surface 52*a* covers the open region on the side 51*a* of the body portion 51.

When the lid portion 52 faces the body portion 51, the engagement hole portion 54 is located on the back side of the body portion 51, that is, at a position where the engagement hole portion 54 faces an outer part of the body portion 51 when the lid portion 52 is fixed and the engagement hole portion 54 does not provide a space through which foreign matter can enter the inside of the body portion 51. The engagement hole portion 54 includes notch portions 54*a* that are formed opposite to each other at respective side portions of the engagement hole portion 54 that are located on both sides of the engagement hole portion 54 in a length direction thereof, and protrudes outwards in the length direction in such a manner as to correspond to the protruding portions 53*b* of the engagement claw portion 53.

It is preferable that the notch portions 54*a* be located at central portions of the respective side portions of the engagement hole portion 54. In the case where the notch portions 54*a* are provided at respective end portions of the engagement hole portion 54, the end portions are made thin, as a result of which the strengths of the engagement hole portions 54 may be reduced. However, since the notch portions 54*a* are provided at the respective central portions, the engagement hole portion 54 can ensure a sufficient strength since the end portions are not made thin. Furthermore, it is preferable that the notch portions 54*a* be located outward of the respective central portions of the side portions of the engagement hole portion 54. As a result, when the engagement claw portion 53 is inserted into the engagement hole portion 54, the insertion amount of the engagement claw portion 53 at the time of inserting the engagement claw portion 53 into the engagement hole portion 54 can be reduced, and also at that time, it is possible to prevent the engagement claw portion 53 from interfering with or contacting other components.

When the protruding portions 53*b* of the engagement claw portion 53 configured as described above passes through the notch portions 54*a* of the engagement hole portion 54 formed at the lid surface 52*a* of the lid portion 52, the engagement claw portion 53 is inserted through the engagement hole portion 54, and is engaged with the engagement hole portion 54 such that the engagement claw portion 53 can be slid along the engagement hole portion 54 in a depth direction by a distance X. That is, the lid portion 52 is engaged with the body portion 51 by the engagement mechanism portions 58, and is held such that the lid portion 52 can be slid along the engagement hole portion 54 in the depth direction by the distance X.

In this case, as illustrated in FIGS. 7 and 8, the distance X is a distance by which the lid portion 52 can be slid, and is a distance that is obtained by subtracting a sheet thickness B of the engagement claw portion 53 from a dimension A of the engagement hole portion 54. A dimension C1 of the notch portions 54*a* and a dimension C2 of the engagement hole portion 54 correspond to a dimension C3 of the protruding portions 53*b* and a dimension C4 of the engagement claw portion 53, respectively. The engagement claw portion 53 has the protruding portions 53*b* to prevent the lid portion 52 that is in an opened state from dropping off from a high place. The engagement hole portion 54 has the notch portions 54*a*, whereby the lid portion 52 can be easily attached to and detached from the body portion 51. Furthermore, the engagement hole portion 54 serves as a positioning member at the time of fixing the lid portion 52 to the body portion 51, and also serves as a guide at the time of sliding the lid portion 52. Therefore, it is unnecessary to additionally provide a positioning member and a guide.

As illustrated in FIG. 9, when the notch portions 54*a* (see FIG. 8) of the engagement hole portion 54 are located symmetric in the lateral direction on the plane of the drawing, a distance D1 from the end portion of the lid portion 52 is ensured, whereby the strength of the lid portion 52 is not insufficient. Also, since a distance D2 from the end portion of the lid portion 52 is ensured, whereby when the lid portion 52 is opened/closed after being set to the body portion 51, the lid portion 52 can be prevented from interfering with or contacting other components by reducing the range through which the lid portion 52 passes as much as possible. It should be noted that the above description is made referring to the case where the notch portions 54*a* are located symmetric in the lateral direction in the engagement hole portion 54, however, it is not limiting. It is possible to change the position of each of the notch portions 54*a* in accordance with the state of attachment of the lid portion to the body portion.

In Embodiment 1, as illustrated in FIG. 7, in the lid portion 52, keyholes 55 for screws 56 are formed for fixation of the lid portion 52 to the body portion 51. The keyholes 55 each have a widened portion 55*a* through which a head part of an associated screw 56 can pass, and an elongated hole portion 55*b* through which only a base part (not illustrated) of the screw 56 can pass. The screw 56 does not need to be completely removed from the body portion 51, that is, the screw 56 is loosened by a given amount, and in this state, the screw 56 is kept screwed to the body portion 51. In this state, the lid portion 52 is slid such that the screw 56 is relatively moved toward the widened portion 55*a* along the elongated hole portion 55*b* of the keyhole 55. Accordingly, the lid portion 52 can be opened relative to the body portion 51. At this time, the distance X that is the sliding amount in the keyhole 55 is set equal to the distance X that is the sliding amount in the engagement hole portion 54.

In the electrical-component storage box 50 configured as described above, the lid portion 52 is engaged with the body portion 51 by the engagement mechanism portions 58. Thus, when the lid portion 52 is released from fixation by the screws 56 by unfixing the screw 56 and is then opened, the engagement claw portion 53 is slidably held by the engagement hole portion 54. Therefore, a worker can do on-site wiring work and maintenance work after installation of the indoor unit 20 at a ceiling, without taking care not to cause the lid portion 52 to drop. Moreover, the lid portion 52 has the keyholes 55, and the lid portion 52 can be opened/closed simply by loosening the screws 56 by an amount by which the lid portion 52 is slidable through the keyholes 55. Therefore, time and labor that are required to insert and remove the screws 56 each time the lid portion 52 is opened/closed in existing indoor units can be saved. Therefore, on-site wiring work and maintenance work after installation of the indoor unit 20 at a ceiling can be more easily done. It is therefore possible to improve the operating efficiency of the work that is done especially at a high place or in a narrow work space.

<Advantages of Embodiment 1>

In the indoor unit 20 according to Embodiment 1 as described above, the lid portion 52 is detachably attached to the body portion 51 by the engagement mechanism portions 58, and is fixed to the body portion 51 by the screws 56. Since the keyholes 55 for the screws 56 are formed in the lid portion 52, the screws 56 can be screwed to the body portion 51 in a loosened state, that is, without being completely removed. Accordingly, in this case, the lid portion 52 can be slid such that the screws 56 are relatively shifted along the keyholes 55, whereby the lid portion 52 can be opened and closed. It is therefore possible to save the time and effort required to insert and remove the screws 56 into and from the lid portion 52 at the time of on-site wiring work and maintenance work after installation of the indoor unit 20 in the ceiling, and simplify the work that is done especially at a high place or in a narrow work space after the installation of the indoor unit 20 at the ceiling. Accordingly, the operating efficiency can be improved.

The engagement claw portion 53 is bent rearward from the proximal end portion 53*c* toward the distal end portion 53*a* such that the engagement claw portion 53 is parallel to the open region on the side 51*a* of the body portion 51. It is therefore possible to prevent the lid portion 52 from falling off at the time of attaching the lid portion 52 to the body portion 51, and can improve the workability.

The engagement hole portions 54 are each located at a position where the engagement hole portion 54 does not provide a space through which foreign matter can enter the interior of the body portion 51 when the lid portion 52 is fixed thereto. It is therefore possible to prevent foreign matter from entering the inside of the body portion 51 when the lid portion 52 is fixed thereto.

Furthermore, the notch portions 54*a* are located at the central portions of the respective side portions of the engagement hole portion 54 that are located opposite to each other in the length direction. Thus, as compared with the case where the notch portions 54*a* are located at respective end portions of the engagement hole portion 54, the engagement hole portion 54 can ensure a sufficient strength since the end portions are not made thin. In addition, the notch portions 54*a* are located at the central portions of the respective side portions of the engagement hole portion 54, whereby the work to engage the body portion 51 and the lid portion 52 with each other is further facilitated, as compared with the case where the notch portions 54*a* are located at the respective end portions of the engagement hole portion 54.

Furthermore, in the case where the notch portions 54*a* are provided outward of the central portions of the respective side portions of the engagement hole portion 54, at the time of inserting the engagement claw portion 53 into the engagement hole portion 54, the insertion amount of the engagement claw portion 53 can be reduced. That is, the above configuration is provided such that when being opened and closed, the lid portion 52 passes though the smallest possible region. It is therefore possible to prevent the lid portion 52 from interfering with or contacting other components.

Embodiment 2

<Refrigerant Circuit of Air-Conditioning Apparatus>

Figure 10:
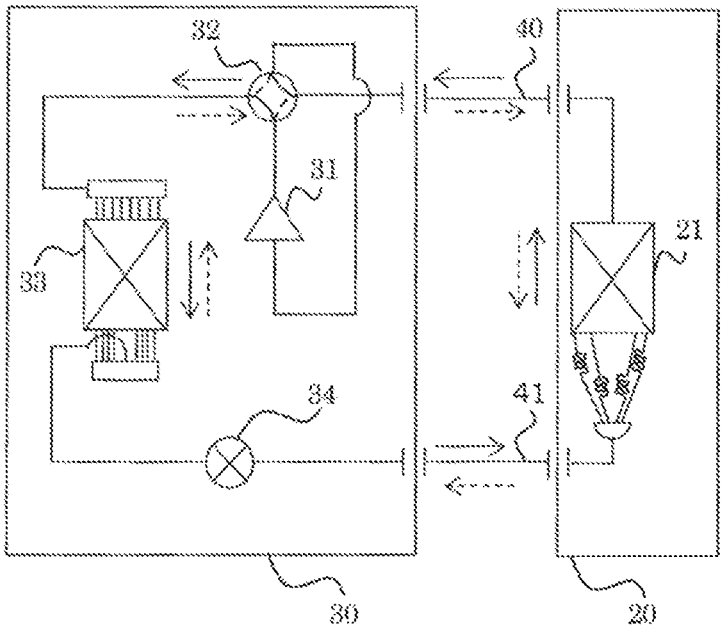
FIG. 10 is a schematic view illustrating a refrigerant circuit of an air-conditioning apparatus according to Embodiment 2 of the present disclosure.

FIG. 10 is a schematic view illustrating a refrigerant circuit of an air-conditioning apparatus according to Embodiment 2 of the present disclosure. In the air-conditioning apparatus as illustrated in FIG. 10, an outdoor unit 30 and the indoor unit 20 as described regarding Embodiment 1 are connected by a gas-refrigerant pipe 40 and a liquid-refrigerant pipe 41 to form a refrigeration cycle circuit. The outdoor unit 30 includes a compressor 31, a four-way valve 32, an outdoor heat exchanger 33, and an expansion valve 34.

The compressor 31 compresses sucked refrigerant and discharges the compressed refrigerant. For example, the compressor 31 may be a compressor whose capacity is changed by arbitrarily changing an operating frequency using, for example, an inverter circuit; however, the compressor 31 is not limited to such a compressor. The capacity of the compressor 31 means the amount of refrigerant that is sent per unit time. The four-way valve 32 is, for example, a valve that switches the flow direction of refrigerant between the flow direction of the refrigerant in a cooling operation and that in a heating operation, depending on whether the operation is the cooling operation or the heating operation.

The outdoor heat exchanger 33 causes heat exchange to be performed between refrigerant and outdoor air. For example, in the heating operation, the outdoor heat exchanger 33 operates as an evaporator, and evaporates and gasifies the refrigerant. In the cooling operation, the outdoor heat exchanger 33 operates as a condenser, and condenses and liquefies the refrigerant.

The expansion valve 34 reduces the pressure of the refrigerant to expand the refrigerant, and includes an expansion device, a flow-rate control unit, and other components. For example, in the case where the expansion valve 34 is an electronic expansion valve, the opening degree of the expansion valve 34 is adjusted in response to an instruction from, for example, a controller (not illustrated).

The indoor unit 20 houses the indoor heat exchanger 21 in the housing 2, and is covered with the decorative panel 3. The decorative panel 3 is fixed to the housing 2, with the temporary levers 8 at the decorative panel 3 temporarily hooked to the temporary hooks 9 at the housing 2. The indoor heat exchanger 21 causes heat exchange to be performed between, for example, air in the indoor space 1 and refrigerant. The indoor heat exchanger 21 operates as a condenser in the heating operation and condenses and liquefies the refrigerant. The indoor heat exchanger 21 operates as an evaporator in the cooling operation and evaporates and gasifies the refrigerant.

<Example of Cooling Operation and Heating Operation of Air-Conditioning Apparatus>

Next, the cooling operation of the air-conditioning apparatus will be described on the basis of the flow of refrigerant. During the cooling operation, a flow passage in the four-way valve 32 is switched to a flow passage indicated by solid lines in the figure. High-temperature and high-pressure gas refrigerant that is discharged from the compressor 31 after being obtained by compression by the compressor 31 passes through the four-way valve 32, and then flows into the outdoor heat exchanger 33. Then, the gas refrigerant passes through the outdoor heat exchanger 33, exchanges heat with the outdoor air, and is thereby condensed and liquefied to change into liquid refrigerant. The liquid refrigerant flows into the expansion valve 34. The liquid refrigerant is reduced in pressure by the expansion valve 34 to change into two-phase gas-liquid refrigerant, and the two-phase gas-liquid refrigerant flows out from the outdoor unit 30.

The two-phase gas-liquid refrigerant that has flowed out from the outdoor unit 30 passes through the liquid-refrigerant pipe 41, flows into the indoor unit 20, and passes through the indoor heat exchanger 21. Then, the two-phase gas-liquid refrigerant exchanges heat with, for example, air in the indoor space 1 (see FIG. 1) and is thereby evaporated and gasified to change into gas refrigerant. Then, the gas refrigerant flows out from the indoor unit 20.

The gas refrigerant that has flowed out from the indoor unit 20 passes through the gas-refrigerant pipe 40, and flows into the outdoor unit 30. The gas refrigerant then passes through the four-way valve 32 and is re-sucked into the compressor 31. In the above manner, the refrigerant circulates in the air-conditioning apparatus, whereby the cooling operation is performed by air conditioning.

Next, the heating operation will be described on the basis of the flow of refrigerant. During the heating operation, the flow passage in the four-way valve 32 is switched to a flow passage indicated by dotted lines in the figure. High-temperature and high-pressure gas refrigerant that is discharged from the compressor 31 after being obtained by compression by the compressor 31 passes through the four-way valve 32, and then flows out from the outdoor unit 30. The gas refrigerant that has flowed out from the outdoor unit 30 passes through the gas-refrigerant pipe 40 and flows into the indoor unit 20. Then, while passing through the indoor heat exchanger 21, the gas refrigerant exchanges heat with, for example, air in the indoor space 1, and is thereby condensed and liquefied to change into liquid refrigerant. Then, the liquid refrigerant flows out from the indoor unit 20.

The liquid refrigerant that has flowed out from the indoor unit 20 passes through the liquid-refrigerant pipe 41 and flows into the outdoor unit 30. The liquid refrigerant is reduced in pressure by the expansion valve 34 to change into two-phase gas-liquid refrigerant, and the two-phase gas-liquid refrigerant flows into the outdoor heat exchanger 33. Then, the two-phase gas-liquid refrigerant then flows through the outdoor heat exchanger 33, exchanges heat with outdoor air, and is thereby evaporated and gasified. The gasified refrigerant passes through the four-way valve 32 and is re-sucked into the compressor 31. In such a manner, the refrigerant circulates in the air-conditioning apparatus, whereby the heating operation is performed by air conditioning.

Regarding Embodiment 2, the indoor unit 20 that is of a four-way cassette ceiling concealed type and blows air in four directions is described above. However, Embodiment 2 can also be applied to an indoor unit 20 that blows air, for example, in two or three directions.

<Advantages of Embodiment 2>

In the air-conditioning apparatus according to Embodiment 2, the electrical-component storage box 50 is provided in the housing 2 of the indoor unit 20. In the electrical-component storage box 50, the lid portion 52 is detachably engaged with the body portion 51 by the engagement mechanism portions 58, and the lid portion 52 is also fixed to the body portion 51 by the screws 56. In the lid portion 52, the keyholes 55 for the screws 56 are formed. The screws 56 are screwed to the body portion 51 in a loosened state, that is, without being completely removed, and in this state, the lid portion 52 is slid such that the screws 56 are relatively shifted along the keyholes 55, whereby the lid portion 52 is openable/closable. It is therefore possible to save time and labor that are required in the case of inserting and removing the screws 56 into and from the lid portion 52 at the time of doing on-site wiring work and maintenance work after installation of the indoor unit 20 at the ceiling, and simplify the work that is done especially at a high place or in a narrow work space after the installation of the indoor unit 20 at the ceiling. Accordingly, the operating efficiency can be improved.

REFERENCE SIGNS LIST

1: indoor space, 2: housing, 3: decorative panel, 4: suction grille, 5: bell mouth, 6: air inlet space, 7: air-inlet edge portion, 8: temporary lever, 9: temporary hook, 10: setting screw portion, 11: air outlet, 20: indoor unit, 21: indoor heat exchanger, 30: outdoor unit, 31: compressor, 32: four-way valve, 33: outdoor heat exchanger, 34: expansion valve, 40: gas-refrigerant pipe, 41: liquid-refrigerant pipe, 50: electrical-component storage box, 51: body portion, 51*a*: side, 52: lid portion, 52*a*: lid surface, 53: engagement claw portion, 53*a*: distal end portion, 53*b*: protruding portion, 53*c*: proximal end portion, 54: engagement hole portion, 54*a*: notch portion, 55: keyhole, 55*a*: widened portion, 55*b*: elongated hole portion, 56: screw, 57: terminal block, 58: engagement mechanism portion, A: dimension, B: sheet thickness, C1 to C4: dimension, D1, D2: distance, X: distance

The invention claimed is:

1. An indoor unit comprising:

a housing; and an electrical-component storage box housed in the housing, and configured to store electrical components, wherein the electrical-component storage box includes a body formed such that an open region is provided on at least one side of the body, and configured to store the electrical components, a lid configured to cover the open region on the at least one side of the body, and an engagement mechanism configured to engage the body and the lid with each other such that the lid is detachable form the body, wherein the engagement mechanism includes at least one engagement claw having a strip shape and provided at one of the body and the lid, and includes at least one engagement hole into which the engagement claw is inserted, the engagement hole having a rectangular shape and being formed at the other of the body and the lid, wherein the engagement claw each includes protrusions that are located opposite to each other on respective both opposite sides of the engagement claw in a length direction thereof, the protrusions protruding outward in the length direction, the engagement hole each includes longitudinal sides, and notches that are located opposite to each other at respective both opposite longitudinal ends of the engagement hole in a length direction thereof, the notches being formed in such a manner as to correspond in shape to the protrusions of the engagement claw, the notches protruding outward in the length direction, the lid includes a keyhole for a screw to fix the lid to the body, and a sliding amount of the screw in the keyhole is equal to a sliding amount of the engagement claw in a depth direction in a distance between the longitudinal sides of the engagement hole.

2. The indoor unit of claim 1, wherein the engagement claw is bent outward from a proximal end portion of the engagement claw toward a distal end thereof in a direction parallel to the open region on the at least one side of the body, or is bent outward in a direction parallel to a lid surface of the lid, the lid surface covering the open region on the at least one side of the body.

3. The indoor unit of claim 1, wherein the engagement hole is located at a position where the engagement hole does not provide a space through which foreign matter is allowed to enter an inside of the body when the lid is fixed to the body.

4. The indoor unit of claim 1, wherein the notches are provided at central portions of the respective opposite sides of the engagement hole.

5. The indoor unit of claim 1, wherein the notches are provided outward of central portions of the respective opposite sides of the engagement hole portion.

6. An air-conditioning apparatus comprising:

the indoor unit of claim 1; and an outdoor unit, wherein the indoor unit includes an indoor heat exchanger, the outdoor unit includes an outdoor heat exchanger, a compressor, and an expansion device, and the indoor heat exchanger and the outdoor heat exchanger are connected by pipes to form a refrigerant circuit.

* * * * *